US007516784B2

(12) United States Patent
Maguire

(10) Patent No.: US 7,516,784 B2
(45) **Date of Patent: *Apr. 14, 2009**

(54) IN-SITU METHOD OF COAL GASIFICATION

(76) Inventor: James Q. Maguire, 1515 W. Main, Norman, OK (US) 73069

( * ) Notice: Subject to any disclaimer, the term of this patent is extended or adjusted under 35 U.S.C. 154(b) by 107 days.

This patent is subject to a terminal disclaimer.

(21) Appl. No.: 11/849,842

(22) Filed: Sep. 4, 2007

(65) Prior Publication Data

US 2007/0295503 A1 Dec. 27, 2007

Related U.S. Application Data

(63) Continuation of application No. 11/445,356, filed on Jun. 1, 2006, now Pat. No. 7,264,049, which is a continuation-in-part of application No. 11/074,150, filed on Mar. 7, 2005, now Pat. No. 7,198,107.

(60) Provisional application No. 60/571,183, filed on May 14, 2004.

(51) Int. Cl.
*E21B 43/30* (2006.01)

(52) U.S. Cl. ..... 166/245

(58) Field of Classification Search ..... None
See application file for complete search history.

(56) References Cited

U.S. PATENT DOCUMENTS 3,612,192 A 10/1971 Maguire, Jr.
4,087,130 A 5/1978 Garrett
4,265,310 A 5/1981 Britton et al.
5,558,160 A 9/1996 Tudor
2006/0213658 A1* 9/2006 Maguire ..... 166/245

OTHER PUBLICATIONS

Harry C. Carpenter & Harold W. Sohns, From Annual symposium on Oil Shale-1968, Application of Aboveground Retorting Variables To In Situ Oil Shale Processing, p. 815.
Memo to James Q. Maguire, Inc., from William W. Lewis dated May 28, 2002, regarding Air Separation Units.
C.H. Bowman, dated Mar. 1965, A Two-Spot Combustion Recovery Project, Society of Petroleum Engineers of Aime.
Colorado School of Mines Research Institute, In-Situ Processing, Section 6 p. 51 date not available.
Isothermal Properties for Nitrogen, dated Jun. 17, 2003, Fluid Data.

* cited by examiner

*Primary Examiner*—William P Neuder
(74) *Attorney, Agent, or Firm*—Dunlap Codding, P.C.

(57) ABSTRACT

A method is provided for in-situ gasification of coal wherein a network of fractures is formed by providing a substantially vertically disposed borehole and a plurality of substantially horizontally disposed boreholes in fluid communication with the substantially vertically disposed borehole, at least one substantially horizontally disposed boreholes being a fracturing borehole, at least one substantially horizontally disposed boreholes being an injection borehole and at least one substantially horizontally disposed boreholes being an injection borehole. An initial quantity of liquified gas is introduced into the at least one substantially horizontally disposed fracturing borehole whereby the liquified gas vaporizes forms fractures in the formation. An additional quantity of liquified gas is injected into the substantially horizontally disposed fracturing borehole and vaporizes whereby a resulting increase in pressure in its at least one substantially horizontally disposed fracturing borehole forms additional fractures in the formation.

11 Claims, 1 Drawing Sheet

IN-SITU METHOD OF COAL GASIFICATION

CROSS-REFERENCE TO RELATED APPLICATIONS

This application is a continuation of U.S. Ser. No. 11/445,356, filed Jun. 1, 2006 now U.S. Pat. No. 7,264,049, which is a continuation-in-part of U.S. Ser. No. 11/074,150, filed Mar. 7, 2005, now U.S. Pat. No. 7,198,107, which claims the benefit of U.S. Provisional Application No. 60/571,183, filed May 14, 2004, each of which is hereby incorporated herein by reference.

BACKGROUND OF THE INVENTION

1. Field of the Invention

The present invention relates to in-situ methods of coal gasification, and more particularly but not by way of limitation, to methods of forming fractures in subterranean coal bearing formations by injecting liquified gases into at least one substantially horizontally disposed fracturing borehole drilled into the formation, and thereafter igniting the coal in the fractured formation and recovering the resulting hot gases via a producer well.

2. Brief Description of Related Art

Coal gasification is a process that converts coal from a solid to a product gas. Underground or subterranean coal gasification involves controlled conversion of coal to a combustible product gas containing methane, hydrogen, carbon monoxide, and carbon dioxide, with minor amounts of impurities. An underground or subterranean coal gasification process involves pumping an oxidant (air or oxygen) and steam down an injection well into a coal seam, igniting the coal and recovering the product gas resulting from combustion of the coal via a production well.

For nations, such as the United States, which have large coal resources and decreasing petroleum and natural gas reserves, the need for producing gas from coal increases. Several coal gasification processes have heretofore been employed. The most common process utilizes lump coal and a vertical retort. Air and coal are fed into the top of the retort and steam is introduced into the bottom of the retort. The air, gas and steam heat the coal and react with the coal to convert it to gas. When air and steam are used as the reacting gases, water gas is produced: whereas, when air and steam are used as the reacting gases, producer gas is produced.

Two additional commercial processes have been employed to gasify coal, namely the Winkler process and the Koppers-Totzek process. The Winkler process employs a fluidized bed in which powered coal is agitated with reactant gases, i.e., steam and oxygen. However, in the Koppers-Totzek process, which operates at a much higher temperature, the powered coal is reacted with steam and oxygen while it is entrained with the gases passing through the reactor. Each of the above-referenced process are used for fuel gas production and in the generation of gases for chemical and fertilizer production.

Numerous in-situ coal gasification processes to recover hydrocarbons from coal have heretofore been proposed. Such in-situ processes have generally encountered control problems and have not proven to be economically feasible. However, in-situ coal gasification represents a technology with considerable potential in power generation, industrial applications and petrochemical feedstocks for countries such which have vast coal deposits, as the United States.

Therefore, new and improved economical and commercially feasible processes for in-situ coal gasification are being sought which overcome various problems, including those described above. It is to such new and improved process that the present invention is directed.

SUMMARY OF THE INVENTION

Figure 1:
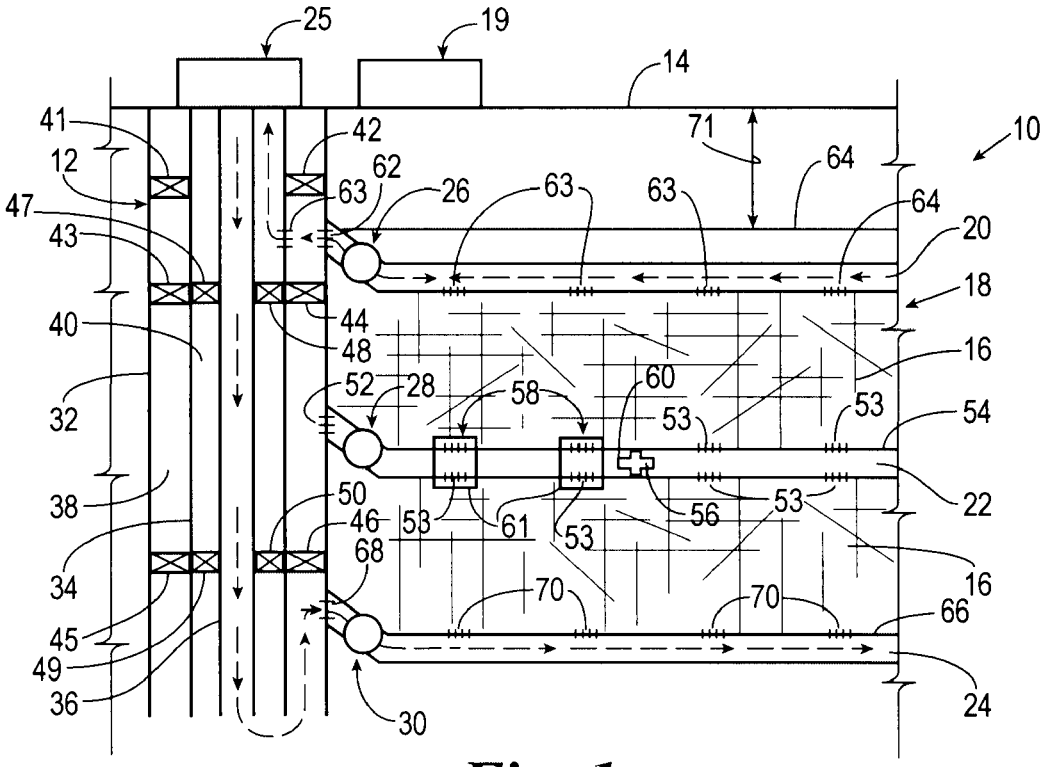
FIG. 1 is a pictorial representation of a fractured formation containing a coal seam wherein the formation has been fractured in accordance with the present invention.

In accordance with the present invention, a method for forming fractures in a formation to enhance coal gasification is provided. In one aspect, the method of forming fractures in a formation includes providing a substantially vertically disposed borehole (i.e., a motherbore) and a plurality of substantially horizontally disposed boreholes extending outwardly from the substantially vertically disposed borehole. Each of the substantially horizontally disposed boreholes is provided with a remotely controlled valve assembly so that the substantially horizontally disposed boreholes can be selectively closed off from the substantially vertically extending borehole or selectively opened to provide fluid communication between one or more of the substantially horizontally disposed boreholes and the substantially vertically extending borehole. Of the plurality of substantially horizontally disposed boreholes, at least one is an injection borehole, at least one is a fracturing borehole, and at least one is a production borehole.

To fracture the formation in order to enhance access to the coal seam contained within the formation and the recovery of gases resulting from in-situ coal gasification, the valve assemblies associated with the at least one injection borehole and the at least one is a production borehole are closed and the remotely controlled valve assembly associated with the at least one fracturing borehole is opened. An initial quantity of liquified gas is introduced into the at least one substantially horizontally disposed fracturing borehole whereby liquified gas is discharged into the formation. The initial quantity of liquified gas is allowed to vaporize in a portion of the at least one substantially horizontally disposed fracturing borehole whereby a resulting increase in pressure in the at least one substantially horizontally disposed fracturing borehole forms fractures in the formation. Once the initial quantity of liquified gas has expanded and produced an initial network of fractures in the formation, an additional quantity of liquified gas is introduced into the at least one substantially horizontally disposed fracturing borehole. The additional quantity of liquified gas is allowed to vaporize in the fractures in the formation created by the injection of the initial quantity of liquified gas into the at least one substantially horizontally disposed fracturing borehole whereby a resulting increase in pressure in the at least one substantially horizontally disposed fracturing borehole forms additional fractures in the formation (i.e., a network of cross fractures).

Once the formation has been fractured by the introduction of the initial and additional quantities of liquified gas, the remotely controlled valve associated with the at least one substantially horizontally disposed fracturing borehole is closed and the remotely controlled valves associated with the at least one substantially horizontally disposed injection borehole and the at least one substantially horizontally disposed production borehole are opened. An oxidant, such as air or oxygen, and steam are then introduced into the at least one substantially horizontally disposed injection borehole so that upon ignition of the coal hot, pressurized gases are produced which travel upwardly through the fractures to the substantially horizontally disposed production borehole. The hot, pressurized gases resulting from coal gasification are then recovered at the surface and subjected to conventional separation and recovery techniques.

When the multiple fracture system is provided with more than one substantially horizontally disposed injection borehole, more than one substantially horizontally disposed fracturing borehole, and more than one substantially horizontally extending production borehole, the remote controlled valves associated with each of such boreholes is closed during introduction of the initial quantity and the additional quantity of the liquified gas except for the fracturing borehole into which the liquified gas is being introduced to provide the desired network of fractures in the formation. It should be noted that the multiple fracture system is designed to provide an effective amount of overburden formation to insure that the fractures do not penetrate the surface.

DETAILED DESCRIPTION

The present invention relates to an improved method for fracturing coal-bearing subterranean formations to enhance the production of combustible product gas containing methane, hydrogen, carbon monoxide, and carbon dioxide, with minor amounts of impurities by in-situ coal gasification. Thus, no mining, crushing or disposal of spent coal residue is required.

To accomplish in-situ subterranean coal gasification in accordance with the present invention it is necessary to establish multiple fracture system 10. An oxidant, such as air or oxygen, and steam are pumped down a vertical borehole 12 (i.e., the motherbore) and into coal exposed by the multiple fracture system 10. The coal is then ignited and the resulting hot pressurized gases travel upwardly through the multiple fracture system 10 and into the vertical borehole 12 (i.e., the "motherbore") whereby the gases, that include methane, hydrogen, carbon monoxide and carbon dioxide with minor amounts of impurities are recovered at the surface 14 and processed in a conventional manner.

Referring now to FIG. 1, the method for forming fractures 16 in a formation 18 containing a coal seam so that gases produced by coal gasification can be recovered is illustrated. The method includes providing the substantially vertically disposed borehole 12 (i.e., motherbore), a supply of liquified gas 19 and a plurality of substantially horizontally disposed boreholes 20, 22 and 24 extending outwardly from the substantially vertically disposed borehole 12.

The multiple fracturing system 10 further includes conventional production equipment 25 which is associated with the substantially vertically disposed borehole 12 for the recovery and processing of the hot pressurized gases generated by the in-situ, subterranean coal gasification of the coal in the formation 18 in accordance with the present invention.

Each of the substantially horizontally disposed boreholes 20, 22 and 24 is provided with remotely controlled valve assemblies 26, 28 and 30, respectively, so that the substantially horizontally disposed boreholes 20, 22 and 24 can be closed off from the substantially vertically disposed borehole 12 or selectively opened to provide fluid communication between selected substantially horizontally disposed boreholes 20, 22 and 24 and the substantially vertically disposed borehole 12. As shown in FIG. 1, at least one of the substantially horizontally disposed boreholes, such as borehole 24, is an injection borehole, at least one of the substantially horizontally disposed boreholes, such as borehole 22, is a fracturing borehole, and at least one of the substantially horizontally disposed boreholes, such as borehole 20, is a production borehole.

Prior to fracturing the formation, the substantially vertically disposed borehole 12 is provided with a cemented outer casing 32. After fracturing, a medium or inner casing 34 is disposed within the outer casing 32 and lowered to the bottom and tubing 36 is disposed within the medium casing 34. A first annulus 38 is formed between the cemented outer casing 32 and the medium or inner casing 34; and a second annulus 40 is formed between the tubing 36 and the medium or inner casing 34. Packers 41, 42, 43, 44, 45 and 46 are selectively positioned within the first annulus 38; and packers 47, 48, 49 and 50 are selectively positioned within the second annulus 40 as shown. Such a configuration permits fluid communication between the substantially horizontally disposed injection borehole 24 and the substantially horizontally disposed production borehole 20 via the fractures 16 formed in the formation 18. Further, by running the uncemented medium or inner casing 34, the tubing 36 and appropriate packers 45, 46, 49 and 50, an oxidant, such as air or oxygen, and steam can be pumped into the formation 18 via the tubing 36 of the substantially vertically disposed borehole 12 and the injection borehole, i.e., the substantially horizontally disposed borehole 24, and distributed for subsequent upward movement through the fractures 16. After the oxidant and steam have been introduced into the formation 18, the coal is ignited and the resulting gases proceed through the fractures 16 of the formation 18 to the substantially horizontally disposed production borehole 20.

To fracture the formation 18 so that the gases produced by in-situ gasification of the coal can be recovered, the valve assemblies 30 and 26 associated with the substantially horizontally disposed injection borehole 24 and the substantially horizontally disposed production borehole 20, respectively, are closed and the remotely controlled valve assembly 28 associated with the substantially horizontally disposed fracturing borehole 22 is opened. In addition, the packers 45 and 46 are installed at a desired position in the first annulus 38 at a position below perforations 52 in the outer casing 32 so as to provide fluid communication between the first annulus 38 and the substantially horizontally disposed fracturing borehole 22.

Thereafter, an initial quantity of liquified gas is introduced into the substantially horizontally disposed fracturing borehole 22 whereby liquified gas is discharged into the formation 18 via perforations 53 provided at selected positions in a casing 54 surrounding the substantially horizontally disposed fracturing borehole 22. The casing 54 surrounding the substantially horizontally disposed fracturing borehole 22 is provided with a plug catcher 56 which is positioned at about the midpoint of the casing 54. A plurality of rotating sleeve assemblies 58 are supported on the casing 54 for selectively opening and closing off the perforations 53 upstream of the plug catcher 56. When a fracture treatment commences, the rotating sleeve assemblies 58 are closed and the liquified gas goes to the farthest set of downstream perforations 53 in the casing 54. The initial quantity of liquified gas is allowed to vaporize in a portion of the substantially horizontally disposed fracturing borehole 22 whereby a resulting increase in pressure in the substantially horizontally disposed fracturing borehole 22 forms fractures 16 in the formation 18. Once the initial quantity of liquified gas has expanded and produced an initial network of fractures 16 in the formation 18, an additional quantity of liquified gas is introduced into the substantially horizontally disposed fracturing borehole 22. The additional quantity of liquified gas is allowed to vaporize in the fractures 16 in the formation 18 created by the injection of the initial quantity of liquified gas into the substantially horizontally disposed fracturing borehole 22 whereby a resulting increase in pressure in the substantially horizontally disposed fracturing borehole 22 forms additional fractures 16 in the formation 18 (i.e., a network of cross fractures).

After the first set of perforations 53 is treated, a casing plug 60 is pumped into the substantially horizontally disposed fracturing borehole 22 and seats in the plug catcher 56. While being pumped into the substantially horizontally disposed fracturing borehole 22, the casing plug 60, which contains a radio transmitter or other remote control device, activates the rotating sleeve assemblies 58. The rotating sleeve assemblies 58 include a rotating sleeve 61 which is perforated on opposite sides thereof such that upon rotation of the rotating sleeves 61 the perforations 53 upstream of the plug catcher 56 and the casing plug 60 are opened. Remote controlled rotating sleeves are well known in the art, as are remote control devices capable of activating such rotating sleeves. Thus, no further description of such rotating sleeves and/or remote control devices capable of activating such rotating sleeves is believed necessary to permit one skilled in the art to understand and practice the present invention.

To prevent fluids from entering the previously fractured perforations which will be at a lower pressure than the breakdown pressure of the upstream perforations, a packer (not shown) can be set upstream of the plug catcher 56 in a conventional manner.

Once the formation 18 has been fractured by the introduction of the initial and additional quantities of liquified gas, the remotely controlled valve assembly 28 associated with the substantially horizontally disposed fracturing borehole 22 is closed and the remotely controlled valve assemblies 30 and 26 associated with the substantially horizontally disposed injection borehole 24 and the substantially horizontally disposed production borehole 20, respectively, are opened. Further, packers 43 and 44 are installed at a desired position in the first annulus 38 at a position below perforations 62 and 63 in the cemented outer casing 32 and the medium or inner casing 34, respectively, so as to provide fluid communication between the substantially horizontally disposed production borehole 20, the first annulus 38 and the tubing 36 via the perforation 62 and the perforations 63. Packers 45 and 46 are installed at a desired position in the first annulus 38 at a position above perforations 68 in the cemented outer casing 32 and packers 49 and 50 are installed at a desired position within the second annulus 38 so that the oxidant and steam can be pumped down the tubing 36 and into the substantially horizontally disposed borehole 24 (i.e., the injection borehole). Thus, the oxidant and steam can be introduced into the substantially horizontally disposed injection borehole 24 via the tubing 36 and the remotely controlled valve assembly 30 so that as the oxidant and steam exit the substantially horizontally disposed injection borehole 24 via perforations 70 in the casing 66 for upward movement through the fractures 16. Upon ignition of the coal the gases resulting from the burning of the coal (i.e., gasification of the coal) travel upwards through the fractures 16 towards the substantially horizontally disposed production borehole 20.

The casings 64, 54 and 66 of the substantially horizontally disposed boreholes 20, 22 and 24 are not cemented, as is the outer casing 32 of substantially vertically disposed borehole 12. Thus, the perforations 52 provided in selected portions of the cemented outer casing 32 of the substantially vertically disposed borehole 12 provide fluid communication with the substantially vertically disposed borehole 12 and the substantially horizontally disposed borehole 22 (i.e., the fracturing borehole) via the remotely controlled valve assembly 28; whereas, the perforations 62 and 63 provided in selected portions of the outer casing 32 and the medium or inner casing 34 provide communication with the tubing 36 and the fractures 18 in the formation 16 via the substantially horizontally disposed borehole 20 (i.e., the production borehole), the perforations 63 in the casing 64 and the remotely controlled valve assembly 26; and perforations 68 provided in a lower portion of the cemented outer casing 32 of the substantially vertically disposed borehole 12 provide fluid communication with the tubing 36 and the substantially horizontally disposed borehole 24 (i.e., the injection borehole) via the remotely controlled valve assembly 30 substantially as shown in FIG. 1.

As previously stated, perforations 64, 53, and 70, are provided in the casings 64, 54 and 66, respectively, of each of the substantially horizontally disposed boreholes 20, 22 and 24. Thus, the introduction of the initial quantity of liquified gas and the additional quantity of liquified gas into the formation 18, as well as the network of fractures 16 thereby produced, is controllable by the position and number of perforations 53 present in the casing 54 of the substantially horizontally disposed fracturing borehole 22. Further, the substantially horizontally disposed fracturing borehole 22, permits the creation of multiple fractures 16 which enhances recovery of oil shale oil from oil shale or gas from gas hydrates in accordance with the present invention.

When the multiple fracture system 10 is provided with more than one substantially horizontally disposed injection borehole 24, more than one substantially horizontally disposed fracturing borehole 22, and more than one substantially horizontally disposed production borehole 20, the remote controlled valves 30, 28 and 26 associated with each of such boreholes is closed during introduction of the initial quantity and the additional quantity of the liquified gas except for the fracturing borehole 22 into which the liquified gas is being introduced to provide the desired network of fractures 16 in the formation 18. It should be noted that the multiple fracture system 10 is designed to provide an effective amount of overburden formation 71 to insure that the fractures 16 do not penetrate the surface 14.

To create the multiple fracture system 10, a liquified gas, such as liquid nitrogen, is injected into a substantially horizontally disposed injection borehole 22 via the vertical borehole 12 at very high rates and a temperature of about −320° Fahrenheit. After cool-down, the liquid nitrogen will enter created fractures 16 and then vaporize. At standard temperatures and pressure a cubic foot of liquid nitrogen contains 696 SCF of gaseous nitrogen after vaporization.

The critical temperature of liquid nitrogen is −232° R (−228° F.) and its critical pressure is 492 psi. At standard condition, its temperature is −140° R (−320° F.) and pressure is 14.7 psia (pounds per square inch absolute). After the liquid nitrogen enters a fracture and warms up to above −232° R (−228° F.) it will immediately vaporize and attempt to greatly increase its volume.

As will be described in detail later, liquid nitrogen injected at a fracturing pressure of 500 psi will increase its volume by 14 fold at a temperature of −75° F. If, however, no increase in fracture volume occurs, the expansion pressure would increase to approximately 7,000 psia at a temperature of −385° R (−75° F.). See National Institute Standards Technology Tables for the Isothermal Properties For Nitrogen.

The fracture would not maintain a constant volume but neither would it expand instantaneously to maintain the fracturing pressure at 500 psi. Instead a fracturing pressure of about 2000-3000 psia could be maintained in an initial major fracture requiring only 500 psia to propagate. The net effect is to create vertical fractures perpendicular to the initial major fracture despite regional stresses both vertical and horizontal. The rapid increase in expansion pressure coupled with a very high rate of liquid nitrogen injection results in a continuing low level explosion that will create hundreds of cross-hatched or secondary vertical fractures 16 as illustrated in FIG. 1.

As will be described later herein, a ½ length fracture of 220 feet in length and height and 0.2 inches wide will contain 806 cubic feet of void space. An injection rate of 5 BPM of liquid nitrogen will result in 393 cubic feet of vaporized nitrogen being injected at an expansion rate of 14 fold. Therefore, approximately 2 minutes of injection would be required to fill the fracture. However, during this time period the fracture may grow to full length. Thus, during the 2 minute time period an additional 5 barrels of liquid nitrogen is injected.

Also to be considered, a 220 foot fracture could not be created in just 2 minutes of injection. The net effect is a buildup in pressure well beyond the fracturing pressure of 500 psia which would be in the range of a low level explosion. Normally, because of its low Reynold's Number, vaporized nitrogen will not attain significant friction losses even at very high rates of injection because it will still be in laminar flow. However, significant friction pressure might occur because as liquid nitrogen in a fracture vaporizes, it rapidly builds volume and this "churning" could destroy the laminar flow streamlines and could result in friction against the fracture faces. If friction pressure occurs, it would only add to the pressure of expansion of the liquid nitrogen. In addition, as the cryogenic vaporized nitrogen gas proceeds along a fracture a continuous expansion will occur because of the significant increase in temperature.

The process of the present invention will create hundreds of cross-hatched fractures 16 as indicated in FIG. 1. Because of the extensive fracturing, where fractures could be as close as 6 feet apart, and because of the explosive nature of the nitrogen expansion it is believed that no propping of the fractures will be necessary. If, however, closure does occur, the fractures can be re-opened by the injection pressure necessary to inject oxidant and steam into the fracture system 10.

In addition, water released by the combustion process will vaporize to steam and expand to double its water volume. The combustion residue gases will also expand. These expansion forces should offset the narrowing of the fractures because of heat related expansion.

Figure 2:
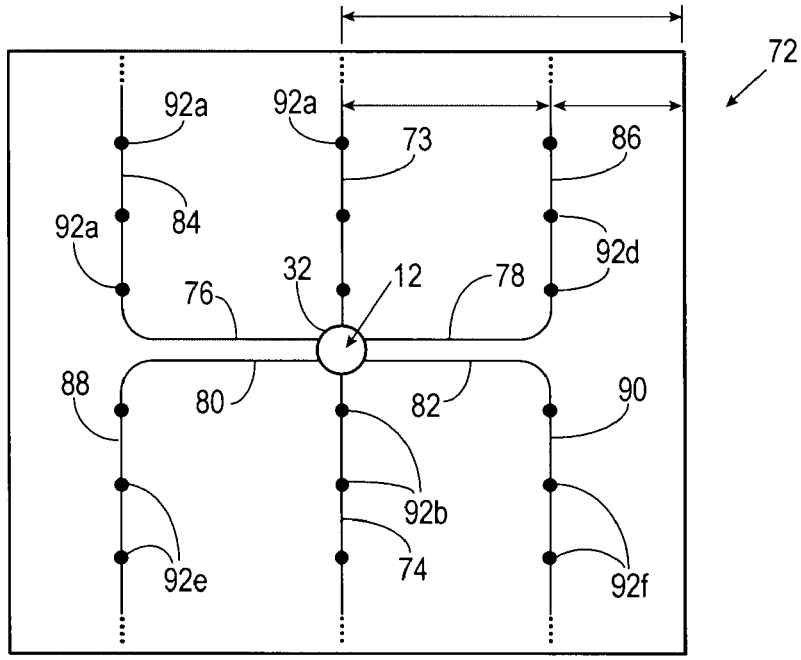
FIG. 2 is a pictorial representation of a 40 acre spacing for drilling and fracturing a formation in accordance with the present invention.

For illustration purposes, a forty acre spacing well 72 is drilled in a manner shown in FIG. 2. The substantially vertically disposed borehole 12 is first drilled to provide at least 600 feet of overburden formation 71 (FIG. 1) above the top of the coal seam or coal zone or deeper in the coal seam or coal zone for adequate coverage so that vertical fractures do not penetrate to the surface 14. The substantially vertically disposed borehole 12 is then cased with the cemented outer casing 32 herein before described.

Two boreholes 73 and 74 are drilled opposite each other from the substantially vertically disposed borehole 12 in a direction perpendicular to the direction of the least regional stresses. Four connecting boreholes 76, 78, 80 and 82 are drilled perpendicular to the boreholes 73 and 74 and the four connecting boreholes 76, 78, 80 and 82 extend a distance of 440 feet (for a 40-acre spacing) from the substantially vertically disposed borehole 12. Four ½ radius boreholes 84, 86, 88 and 90 are drilled and connect with the connecting boreholes 76, 78, 80 and 82 substantially as shown. That is, the borehole 84 is connected to the end of the connecting borehole 76 and the borehole 86 is connected to the end of the connecting borehole 78 so that the boreholes 84 and 86 are substantially parallel to the borehole 73. Similarly, the borehole 88 is connected to the end of the connecting borehole 80 and the borehole 90 is connected to the end of the connecting borehole 82 so that the boreholes 88 and 90 are substantially parallel to the borehole 74. Thus, the boreholes 73, 84, 86 and 74, 88 and 90 would be at the midpoint of a 220 foot section of oil shale.

Since each ½ fracture would have to extend 220 feet horizontally to meet up with a ½ fracture of an adjacent borehole, the vertical fracture will also extend 220 feet in height. In practice, the injection of volumes of liquid gas, such as liquid nitrogen, beyond the necessity of creating 220 feet ½ length fractures will extend the fracturing deeper than 220 feet into the coal seam or coal zone. Further, each of the fracturing boreholes is perforated as herein described. (See Fracture Creation Section).

In thicker coal seams or coal zones sections it may be advantageous to drill additional wells to exploit the deeper sediments rather than to drill additional boreholes in the same well which would take years to heat. Additional horizontal boreholes in the same configuration may also be drilled into the coal seam to distribute the oxidant and stream through out the fractured formation. Other boreholes at the top or upper portion of the coal seam or coal zone may be drilled to act as production boreholes.

Fracture Creation

The greater the number of fractures, the greater the recovery efficiency of gases created by in-situ coal gasification. Thus, the closer the fractures are to each other the greater will be the gas production rate and the greater the efficiency of gasification of the coal.

To create this fracturing program for a vertical fracture system, the large diameter vertical borehole or motherbore 12 is drilled and six substantially horizontally disposed boreholes ( i.e., fracturing boreholes) 73, 74, 84, 86, 88, and 90, along with four connecting substantially horizontally disposed connecting boreholes 76, 78, 80, and 82, are drilled into the coal seam or coal zone as shown in FIG. 2.

The six substantially horizontally disposed boreholes 73, 74, 84, 86, 88, and 90, are drilled such that any vertical fractures created will be perpendicular to the direction of the least regional stress. Each of the substantially horizontally disposed boreholes 73, 74, 84, 86, 88, and 90, is cased with an uncemented casing which contains perforations in the same manner as the substantially horizontally disposed fracturing borehole 22 herein before described, and each of such substantially horizontally disposed fracturing boreholes is fractured separately with multiple fractures in each borehole.

A borehole orientation drilled to conform to a vertical azimuth is believed desirable even if the regional stresses favor a horizontal fracture. If the fracturing pressure is maintained above the fracturing pressure of a horizontal fracture, even if formed first, a vertical fracture will occur in the previously created horizontal fracture and afterwards a horizontal fracture in the previously created vertical fracture. In some situations a vertical fracture will occur in the original vertical fracture parallel to the least regional stresses if it is lower than the stresses in a horizontal fracture.

For illustration purposes, assume the 40 acre spacing well 72 is drilled as shown in FIG. 2 and 4½ inch perforated, uncemented casing is run in the substantially horizontally disposed fracturing boreholes (also referred to hereinafter as boreholes) with the perforations spaced 30 feet apart. The perforations in each of the uncemented casings of the substantially horizontally disposed fracturing boreholes 73, 74, 84, 86, 88, and 90 are indicated in FIG. 2 by the numerals 92*a*, 92*b*, 92*c*, 92*d*, 92*e* and 92*f*, respectively. If a single borehole is fractured separately, each borehole will contain 20 separate sets of perforations. By use of a packer set halfway down the borehole (see FIG. 1), 10 sets of perforations can be treated simultaneously.

If the injection rate is 100 barrels of liquid nitrogen per minute (BPM) each ½ length borehole would fracture at 50 BPM rate or 5 BPM per separate fracture.

At −75° Fahrenheit, this rate after vaporization expands 14 fold to an equivalent rate of 70 BPM. Although this is a very high rate, a method of fracturing and repressuring subsurface geological formations employing liquified gas which may be employed is disclosed in U.S. Pat. No. 3,822,747, the entire contents of which is incorporated herein. It should be noted that the above referenced method, does not depend on frictional pressures to create secondary fractures but rather the secondary fractures will be created by the expansion forces of the vaporizing nitrogen gases.

It will be shown later that a rate of 5 BPM of liquid nitrogen translates to 210 GPM. This volume will occupy the void space of a 220 foot ½ fracture in just 2 minutes of pumping. If the entire fracture is not created in 2 minutes, the result will be a build up in pressure well beyond the fracturing pressure and as a result numerous secondary horizontal and vertical fractures will be created.

For purposes of calculations, assume that 20 separate vertical ½ fractures 220 feet in length are created in a single borehole. This will result in a one "fold" volume of liquid nitrogen. In practice, secondary fractures will be occurring before the 220 foot extension is reached therefore more than one "fold" volume of liquid nitrogen will be required.

A one "fold" volume of liquid nitrogen "theoretically" would result in 20, 220 foot ½ fractures 30 feet apart. The injection of a 5 "fold" volume of nitrogen would result in the "equivalent" of 1200 ½ fractures averaging 6 feet apart. This is important for two reasons:

1. The fracturing of all six (6) boreholes in a 40 acre spacing well may create the equivalent of 1,200 separate ½ fractures. In reality, the fracture system consists of vertical fractures perpendicular to each other both with and against the regional stresses and also the horizontal fractures. This occurs because the injection pressure can be maintained at 2000 to 3000 psi, well above the fracturing pressure of 500 psi.

The fracturing system is not confined to 220 foot fractures. Some fractures will extend into adjacent producing units. However, upon their treatment an equivalent number of fractures will occur in the first units. As a result of all this "cross fracturing" and the creation of 1,200, ½ fractures, the regional stresses overburden pressure can be nullified so that closure of the fractures does not occur.

2. The creation of 1,200, ½ length fractures result in each fracture being the equivalent of six (6) feet apart. This means the combustion front will have to penetrate only three (3) feet to consume all the coal in a particular fracturing block. It also creates a very large surface area for the combustion front.

It is desirable that each of the six separate substantially horizontally disposed fracturing boreholes 73, 74, 84, 86, 88, and 90, be cased with 4½" inch casing. The farthest half of the casing strings having pre-perforated holes or perforations 92 grouped together and spaced 30 feet apart or 10 sets for ½ of the borehole. The 4½" casing is not cemented as the casing pressure will be so high (2000 to 3000 psi plus friction losses) that all perforated intervals will be fractured.

The closer half of the casing, which contain rotating sleeve assemblies, as herein before described with reference to FIG. 1, are spaced 30 feet apart. Each rotating sleeve assembly will contain sets of perforations along with a battery operated rotating sleeve. The rotating sleeve assemblies are run with the rotating sleeve covering the perforations.

A two-stage treatment can be performed by installing an open hole plug catcher midway down the casing string to separate the farthest 10 sets of perforations from the closer sliding sleeve assemblies as herein before described with reference to FIG. 1.

When a fractured treatment commences, the rotating sleeve assemblies are closed and all of the fracture treatment goes into the farthest set of perforations 92 in one of the substantially horizontally disposed fracturing boreholes, such as the borehole 72. Also in the midway point is a "plug catcher". After the first sets of perforations 92 are treated, a casing plug is pumped down the hole and seats in the "plug catcher". While being pumped down the hole, the "casing plug", which also contains a radio transmitter, will activate the battery operated rotating sleeves and the sleeves will rotate and open the upper sets of perforations. With the casing plug in place the upper sets of perforations can be treated. This procedure is repeated for each borehole separately.

A packer is set below the plug catcher to prevent fluids from entering the previously fractured perforations which is at a lower pressure than the breakdown pressure of the upper set of perforations.

The rotating sleeves are pre-perforated with four (4) 1 inch holes approximately 2 inches apart on one side and four (4) holes on the other. This arrangement requires that the rotating sleeves be rotated only 3 inches to open.

Larger Spacing Units

Because of the mountainous terrain it may be necessary to drill certain wells on spacing units greater than 40 acres. Also, field operations may indicate the feasibility of a larger spacing on a nominal basis. The drilling of additional connecting boreholes can be made to the 40 acre spacing well illustrated in FIG. 2. This will allow the drilling of another fracturing borehole parallel to the original off well fracturing borehole at another 440 feet distance. Doing this and extending all fracturing boreholes to a distance of 1100 feet as compared to 660 feet for a 40 acre well will increase the unit spacing to 111 acres.

Further, the drilling of a third fracturing borehole would extend the fracturing borehole to 1540 feet and the unit spacing to 217 acres. Since each borehole will be fractured separately, the fracturing of these additional boreholes will be similar to what has been described for 40 acre spacing except for additional stages required for the added borehole length.

The injection boreholes will be extended from 660 feet at 40 acres to 1100 feet for 111 acres and 1540 feet for 217 acre spacing. The extended injection distance for combustion gases will be more than compensated for by running one or two strings of tubing with packers and utilizing the annulus to separate injection intervals to less than that in a 40 acre well.

In very mountainous territory it will be impossible to drill straight down with a "motherbore" hole. In such cases a long inclined and horizontal borehole can be drilled to a point above the oil shale zone before diverting to a vertical "motherbore" hole.

Generation of Liquid Nitrogen

As shown hereinafter, the cost to generate a gallon of liquid nitrogen is approximately 16 cents per gallon. This cost is based on $40 per ton for a 544 ton plant or $21,760 per day. The plant would require one (1) 1,000 Kw/hr or $10,560 per day of electricity or nearly one half the daily operating costs. Since the in-situ coal gasification process will produce a product gas which includes methane, hydrogen, carbon monoxide and carbon dioxide, fuel will be available to produce on-site electricity which will substantially reduce the indicated 4 cents/Kw-h cost of plant electricity.

Also included in the cost estimate of $40 per ton is a 39% corporate income tax which would not apply to the direct cost. Therefore the estimated direct cost of generating on-site liquid nitrogen could be approximately 10 cents per gallon if electricity is generated for production gases. For a 40 acre well requiring 400,000 gallons of liquid nitrogen the cost of the liquid nitrogen @ 16 cents per gallon would be approximately $64,000.

Calculation of Required Liquid Nitrogen

Assume for a 40 acre spacing well (See FIG. No. 1) the creation of 6 separate horizontal fracturing boreholes 73, 74, 84, 86, 88, and 90, with an initial vertical fracture being created every 30 feet in each borehole.

As seen in FIG. 2, each ½ length "major" fracture would extend 220 feet before linking up with the ½ length fracture of the adjoining borehole, and it is assumed each fracture would be 220 feet in height.

Therefore:

$$\frac{(220\text{ feet})(220\text{ feet})(0.2\text{ inch})}{12\text{ in/ft}} = 806\text{ cubic feet of void space per single }\frac{1}{2}\text{ length fracture.}$$

The volume of liquid nitrogen required after vaporizing at fracturing pressure of 500 psi is as follows:

A SCF of liquid nitrogen will expand to 20.07 cubic feet (see attached tables of Isometric Properties of Nitrogen from NIST) assuming an injection pressure of the liquid nitrogen of 500 psia and −140° R (−320° F.) to 520° R (60° F.) temperature change.

A gallon of liquid nitrogen after vaporization would occupy 2.68 cubic feet @

$$500\ psia\ \frac{20.07\text{ ft}^3}{7.48\text{ g/ft}^3}$$

Therefore one single ½ fracture length would require 301 gallons nitrogen $$\frac{806}{2.68}$$

of liquid nitrogen.

Since it is desirable to create numerous secondary, cross-hatched fractures, additional liquid nitrogen is needed to create secondary fractures. The initial 301 gallons of liquid nitrogen needed to create a "major" fracture is hereby referred to as one "fold" volume. A 5 "fold" volume is recommended to reverse the effects of fracture healing and to decrease the distance the combustion front must travel in each fracture block.

A one "fold" treatment would result in major fractures occurring every 30 feet. A 5 "fold" treatment would create the equivalent of a "major" fracture every 6 feet which would require the combustion front to advance only 3 feet for complete combustion for each block.

In actual practice at least one "major" fracture of 220 foot length would be created and numerous "cross-hatched" vertical and horizontal fractures would occur; however, a 5 "fold" treatment would be the equivalent of 6 "major" fractures.

As to the total volume of liquid nitrogen required consider: 6, ½ fractures to connect clear across a 40 acre spacing unit (1 320 feet) (6 fractures) (301 gal/fracture)=1806 gals. Of liquid nitrogen with "connecting" fractures running every 30 feet a total of 40 would result.

Therefore: (40)(1806)=72,240 gals/"fold" at 5 "folds"

(73,240 gals)(5)=361,200 gal of liquid nitrogen.

Since each gallon of liquid nitrogen can be produced at about 16 cents per gallon additional "fold" would only cost $11,558 each, however, 5 "folds" should be sufficient unless field experience indicates an increase in recoverable reserves would result from increased fracturing or the healing of fractures would be prevented.

The parameters herein before described the successful in-situ production of oil shale are "off the shelf" procedures; that is, liquefaction, nitrogen, and vaporization of liquid nitrogen, horizontal drilling, in-site combustion of hydrocarbons, treatment of produced water and flux gas and refining upgrading.

Successful in-situ coal gasification involves the creation of hundreds of vertical and horizontal, cross-hatched fractures which will allow a vast surface area for the ignition and burning of the coal and alleviate the need to prop open the fractures created. If 1200+fractures are created in a 40 acre well this should prevent the healing of cross-hatched fractures. If not, the pressure necessary to inject combustion gases and the expansion of water to steam will hold open the fractures. But equally important is the creation of the fractures by vaporizing large volumes of liquid nitrogen which will create very large "expansion pressures" well in excess of regional fracture stresses.

Although a single 40 acre spacing well, 220 feet in thickness has been described, it should be understood that as many as 6 wells can be drilled on a 40 acre unit with approximately 1500 feet of oil shale thickness with 4 of those wells being drilled concurrently using countercurrent flow in two of the wells.

After the formation 18 has been fractured by the introduction of the initial and additional quantities of liquified gas, the remotely controlled valve 28 associated with the substantially horizontally disposed fracturing borehole 22 is closed and the remotely controlled valves 26 and 30 associated with the substantially horizontally disposed injection borehole 24 and the substantially horizontally disposed production borehole 20, respectively, are open. An oxidant, such as air or oxygen, and steam are introduced into the substantially horizontally disposed injection borehole 23 via the tubing 36 and a lower portion of the first annulus 38 formed between the cemented outer casing 32 and the medium or inner casing 34 and the perforations 68 in the cemented outer casing 32. Once the required amount of oxidant and steam have been injected into the formation 18. packers 41, 42, 43. 44, 47 and 48 are set and the coal exposed by the fractures 16 in the formation 18 is ignited. Thereafter, the remotely controlled valve 30 associated with the substantially horizontally disposed injection borehole 24 is closed. The gas produced by the coal gasification is driven upwardly through the fractures 16 to the substantially horizontally disposed production borehole 20—wherein the gases are conveyed, via the perforations 62 in the cemented outer casing 32, the perforations 63 in the medium or inner casing 34 and an upper portion of the second annulus 40 to a gas processing station.

Any suitable in-situ coal gasification process can be employed in the practice of the present invention. That is, any coal gasification system can be employed which involves pumping an oxidant, such as air or oxygen, and steam into a subterranean fractured formation as herein before described, igniting the coal in the fractured formation and thereafter recovering the gases generated by the burning of the coal.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A method for enhancing in-situ coal gasification of subterranean coal by providing a network of fractures in a subterranean formation containing seams of coal, the method comprising the steps of:

providing a substantially vertically disposed borehole;

providing a plurality of substantially horizontally disposed boreholes in fluid communication with the substantially vertically disposed borehole, wherein at least one substantially horizontally disposed borehole is a fracturing borehole, at least one substantially horizontally disposed borehole is an injection borehole and at least one substantially horizontally disposed borehole is a production borehole;

selectively preventing fluid communication between the substantially vertically disposed borehole and the at least one substantially horizontally disposed injection borehole and the at least one substantially horizontally disposed production borehole;

introducing an initial quantity of liquified gas into the at least one substantially horizontally disposed fracturing borehole such that the liquified gas communicates with the subterranean formation;

permitting the quantity of liquified gas to vaporize in a portion of the at least one substantially horizontally disposed fracturing borehole whereby a resulting increase in pressure in the at least one substantially horizontally disposed fracturing borehole forms fractures in the subterranean formation;

introducing an additional quantity of liquified gas into the at least one substantially horizontally disposed fracturing borehole;

permitting the additional quantity of liquified gas to vaporize in the at least one substantially horizontally disposed fracturing borehole whereby a resulting increase in pressure in the at least one substantially horizontally disposed fracturing borehole forms additional fractures in the subterranean formation.

2. The method of claim 1 wherein the initial quantity of liquified gas and the additional quantity of liquified gas are each injected at a pressure of at least about 500 psi.

3. The method of claim 2 wherein the injection rate of the initial quantity of liquified gas and the additional quantity of liquified gas is at least about 5 barrels per minute for a period of at least about 2 minutes.

4. The method of claim 1 wherein the initial quantity of liquified gas and the additional quantity of liquified gas are each injected at a pressure of at least about 500 psi.

5. The method of claim 1 wherein the injection rate of the initial quantity of liquified gas and the additional quantity of liquified gas is about 5 barrels per minute for a period of time of about 2 minutes.

6. The method of claim 1 further comprising a network of injection wells in communication with the at least one substantially horizontally disposed fracturing borehole and wherein the initial quantity of liquified gas injected into each injection well is an amount sufficient to fracture the formation at least about ½ the distance between adjacent injection wells and wherein the additional quantity of liquified gas injected into each injection well is an amount sufficient to fracture the formation the remaining distance between adjacent injection wells.

7. A method of in-situ coal gasification of subterranean coal, the method comprising the steps of:

providing a substantially vertically disposed borehole;

providing a plurality of substantially horizontally disposed boreholes in fluid communication with the substantially vertically disposed borehole, wherein at least one substantially horizontally disposed borehole is a fracturing borehole, at least one substantially horizontally disposed borehole is an injection borehole and at least one substantially horizontally disposed borehole is a production borehole;

introducing an initial quantity of liquified gas into the at least one substantially horizontally disposed fracturing borehole such that the liquified gas communicates with the subterranean formation;

permitting the quantity of liquified gas to vaporize in a portion of the at least one substantially horizontally disposed fracturing borehole whereby a resulting increase in pressure in the at least one substantially horizontally disposed fracturing borehole forms fractures in the subterranean formation;

introducing an additional quantity of liquified gas into the substantially horizontally disposed fracturing borehole;

permitting the additional quantity of liquified gas to vaporize in the at least one substantially horizontally disposed fracturing borehole whereby a resulting increase in pressure in its at least one substantially horizontally disposed fracturing borehole forms additional fractures in the subterranean formation;

providing remotely controlled valve assemblies, whereby upon actuating the remotely controlled valve assemblies the at least one substantially horizontally disposed fracturing borehole is closed off from the substantially vertically disposed borehole and the at least one substantially horizontally disposed injection borehole, and the at least one production borehole is in open communication with the substantially vertically disposed borehole;

introducing an effective amount of an oxidant and steam into the network of fractures in the subterranean formation containing a coal seam to support combustion of the coal;

igniting the coal so as to produce resulting hot, pressurized gases containing methane, hydrogen, carbon monoxide and carbon dioxide which travel upwardly through the formation to the at least one production borehole; and recovering the resulting hot, pressurized gases from the at least one production borehole.

8. The method of claim 7 further comprising selectively closing off and establishing fluid communication between selected substantially horizontally disposed boreholes and the substantially vertically disposed borehole.

9. The method of claim 7 wherein the initial quantity of liquified gas and the additional quantity of liquified gas are each injected at a pressure of at least about 500 psi.

10. The method of claim 9 wherein the injection rate of the initial quantity of liquified gas and the additional quantity of liquified gas is at least about 5 barrels per minute for a period of at least about 2 minutes.

11. The method of claim 8 further comprising a network of injection wells in communication with the at least one substantially horizontally disposed fracturing borehole and wherein the initial quantity of liquified gas injected into each injection well is an amount sufficient to fracture the formation at least about ½ the distance between adjacent injection wells and wherein the additional quantity of liquified gas injected into each injection well is an amount sufficient to fracture the formation the remaining distance between adjacent injection well.

* * * * *

UNITED STATES PATENT AND TRADEMARK OFFICE

CERTIFICATE OF CORRECTION

PATENT NO. : 7,516,784 B2
APPLICATION NO. : 11/849842
DATED : April 14, 2009
INVENTOR(S) : James Q. Maguire It is certified that error appears in the above-identified patent and that said Letters Patent is hereby corrected as shown below:

Column 12, line 13: Delete "Of" and replace with -- of --.

Signed and Sealed this

Twenty-eighth Day of July, 2009

JOHN DOLL
*Acting Director of the United States Patent and Trademark Office*